US005864953A

United States Patent [19]

Blake

[11] Patent Number: 5,864,953

[45] Date of Patent: Feb. 2, 1999

[54] TOOL TO REMOVE SURGICAL INSTRUMENT IDENTIFICATION TAPE

[75] Inventor: Kenneth R. Blake, Brooklyn Park, Minn.

[73] Assignee: Scanlan International, Inc., St. Paul, Minn.

[21] Appl. No.: 862,339

[22] Filed: May 23, 1997

Related U.S. Application Data

[63] Continuation of Ser. No. 442,384, May 16, 1995, abandoned.

[51] Int. Cl.[6] ..... B26B 3/00

[52] U.S. Cl. ..... 30/169; 30/279.6; 30/282; 30/90.4; 30/90.8

[58] Field of Search ..... 30/169, 289, 290, 30/282, 291, 279.6, 90.4, 90.6, 90.7, 90.8, 90.9

[56] References Cited

U.S. PATENT DOCUMENTS

| | | | |
|---|---|---|---|
| 972,225 | 10/1910 | Pennell | 30/169 |
| 1,739,972 | 12/1929 | Klinger | 30/289 |
| 1,801,706 | 4/1931 | Westfall | 30/289 |
| 2,439,873 | 4/1948 | Snyder | 30/169 |
| 3,151,510 | 10/1964 | Bunker et al. | 30/90.6 |
| 4,001,934 | 1/1977 | Bell | 30/289 |
| 4,248,660 | 2/1981 | Johnson | 30/169 |
| 4,631,059 | 12/1986 | Wolvek et al. | 30/90.8 |
| 4,799,406 | 1/1989 | Diaz-De-Guerenu-Aguirrebeitia | 30/90.6 |
| 4,813,458 | 3/1989 | Jacobucci | 30/169 |
| 4,897,920 | 2/1990 | Dunbar | 30/90.4 |
| 4,972,581 | 11/1990 | McCollum et al. | 30/90.4 |
| 5,333,342 | 8/1994 | Huang | 30/169 |

FOREIGN PATENT DOCUMENTS

| | | | |
|---|---|---|---|
| 0 021 493 | 1/1981 | European Pat. Off. | 30/282 |

*Primary Examiner*—Rinaldi I. Rada
*Assistant Examiner*—Sean A. Pryor
*Attorney, Agent, or Firm*—Faegre & Benson LLP

[57] ABSTRACT

A cutting tool is described for cutting an encircling band of identification tape from a surgical instrument handle. The tool housing has an elongated guide slot with a cutting blade mounted in the housing on a circumference of the guide slot exposed distally at a distal end of the tool. The channel slot has a circumference to accommodate surgical instrument handles having an arcuate cross-sectional segment having a radius which is equal to or less that the radius of the channel slot circumference. The cutting blade is positioned to be tangent to the surgical instrument handle operatively nested within the guide slot. The blade is also positioned to define a chord of the encircling tape band around the instrument handle nested within the guide slot. In use, the blade cuttingly engages the tape band as the tool is slid along the surgical instrument handle toward the edge of the tape band. The blade cuts a full width of the tape band, exposing a fresh margin of tape to allow complete removal.

9 Claims, 3 Drawing Sheets

TOOL TO REMOVE SURGICAL INSTRUMENT IDENTIFICATION TAPE

This is a continuation of U.S. patent application Ser. No. 08/442,384 filed May 16, 1995, now abandoned.

FIELD OF THE INVENTION

This invention is a cutting tool for removing a full-thickness width of a band of identification tape from a surgical instrument handle.

BACKGROUND OF THE INVENTION

In the medical arts today, there are an increasingly large number of manual instruments available for use by surgeons and other medical personnel. Many of these instruments are named according to broad classifications, such as scissors, clamps, retractors, etc., with a specific term attached thereto to uniquely name the particular instrument within that class. Often, these instruments are each designed and adapted to perform specific functions within specific fields of use. Since the identifying name is usually not marked on the instrument, medical personnel need to remember the appearance, name and use of each instrument. During the performance of surgical operations and procedures, it is crucial that the correct instrument be easily, accurately and quickly identified.

It is also necessary at times to identify which instruments are the property of a specific doctor or surgery team. Use of SURG-I-BAND® marking tape to code surgical instruments to identify them with a particular owner may be done on particular instruments in addition to coding the instruments to identify their size or particular function.

The assignee of the present invention, Scanlan International, Inc., manufactures a pressure-sensitive adhesive tape, known by the proprietary name SURG-I-BAND®, which is available in a variety of colors and widths for application to surgical and medical instruments for use in marking them for easier identification. Since these instruments are generally re-usable, they must be cleaned and sterilized after each use, typically by washing and/or soaking in an anti-bacterial solution, often following by a heat sterilization treatment, such as autoclaving. The tape is thus manufactured of a base material and a suitable adhesive that will resist such repeated treatments.

The SURG-I-BAND® tape deteriorates over time from these treatments and, when it becomes necessary to remove the tape, it is often difficult to do so. One of the changes that is known to occur in the tape over time with repeated sterilization is that the bond between overlapping tape areas becomes increasingly strong, making the removal of the tape by peeling open the bond extremely difficult. In contrast to the tape to tape bond, the bond of the tape to the tool is minimal over time so that the tape may be readily removed from the tool if it is cut across its width.

It is thus an object of this invention to provide a simple cutting tool to cut across the entire width of an encircling identifying tape band to free an edge thereof and thus facilitate easy and complete removal of the identifying tape band.

SUMMARY OF THE INVENTION

The present invention is a cutting tool for removing an encircling band of identification tape from a portion of a surgical instrument handle having a cross section with a generally arcuate segment. The tool comprises a housing with an elongated guide slot opening into one face of the housing. The guide slot has a generally semi-circular cross section and has a longitudinal axis. The semi-circular cross section of the slot has a radius equal to or greater than the maximum radius expected for the arcuate segment of the handle cross section to which the identification tape band has been applied. The guide slot is designed and adapted for receiving the banded portion of the surgical instrument handle in the guide slot as the housing is slid longitudinally along the handle portion. The tool also comprises a cutting blade mounted within the housing adjacent the guide slot with at least a portion of the cutting edge thereof disposed for engaging the outer surface of the handles of instruments received in the guide slot, said blade edge being in alignment with a chord line of the generally semi-circular cross section of the guide slot and constructed and arranged with the cutting edge of the blade slidable along the handle of the surgical instrument until reaching the edge of the encircling tape band whereupon the cutting edge slices into and through the band as the housing is moved longitudinally along the handle of the surgical instrument.

DETAILED DESCRIPTION OF THE INVENTION

Figure 1:
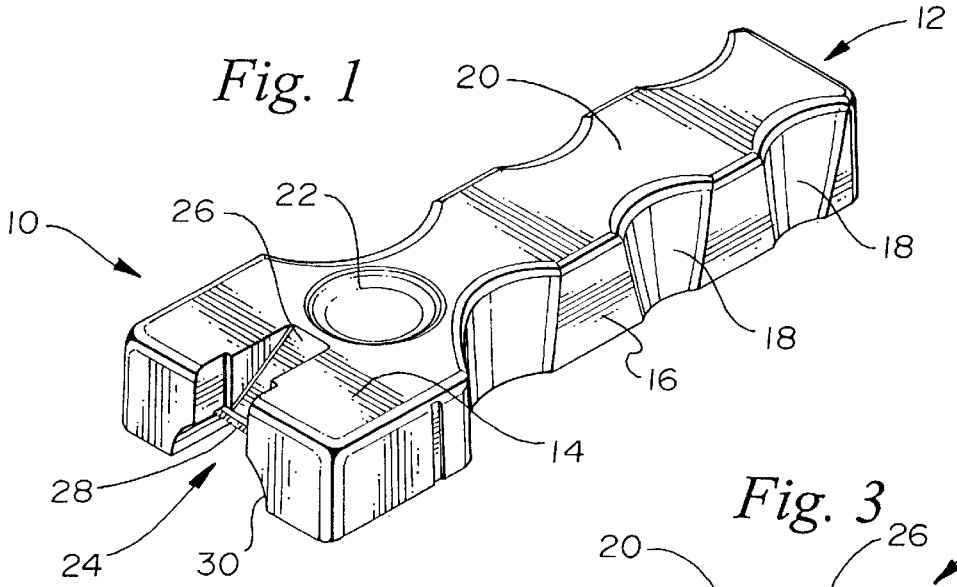
FIG. 1 is a top perspective view of the cutting tool for removing tape bands used to identify surgical instruments.

As can be seen in FIG. 1, the housing of cutting tool 10 of this invention has an elongated handle portion 12 and a head portion 14. The width of head portion 14 is slightly greater than the width of the elongate handle portion 12.

The side walls 16 of the handle 12 have finger holds 18, shaped as concave depressions, which can also be seen in FIGS. 2 and 5–7.

Figure 3:
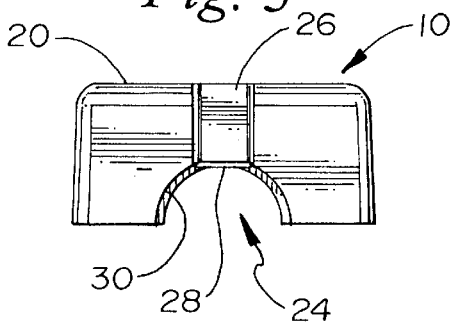
FIG. 3 is a front elevational view of the cutting tool, showing the guide slot and the exposed edge of the cutting blade.
Figure 4:
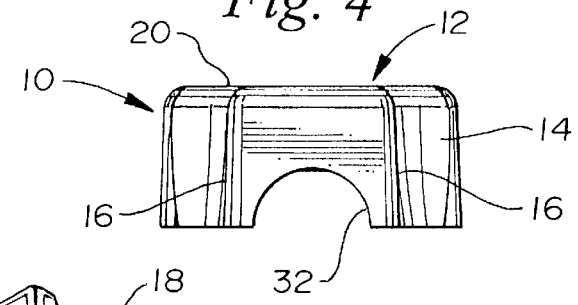
FIG. 4 is a rear elevational view of the cutting tool.
Figure 5:
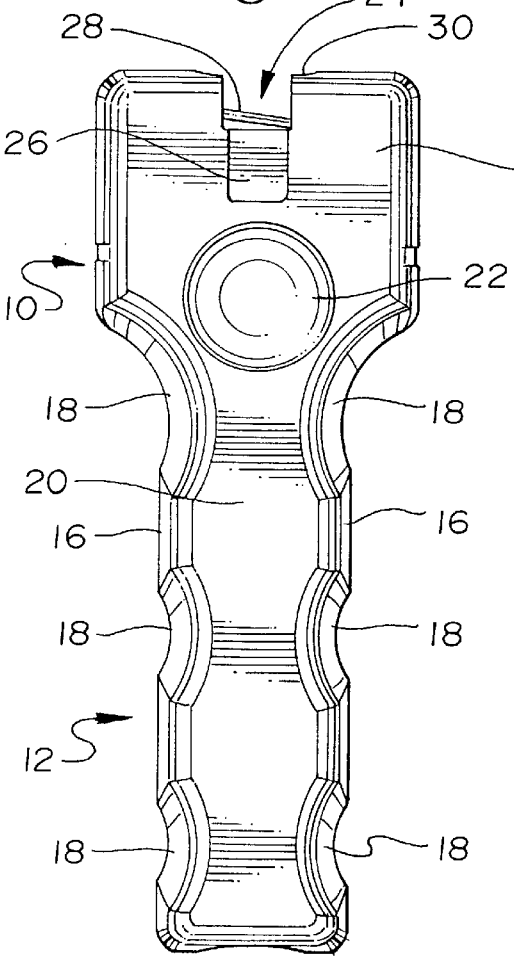
FIG. 5 is a top view of the cutting tool, showing finger guides along the handle.
Figure 6:
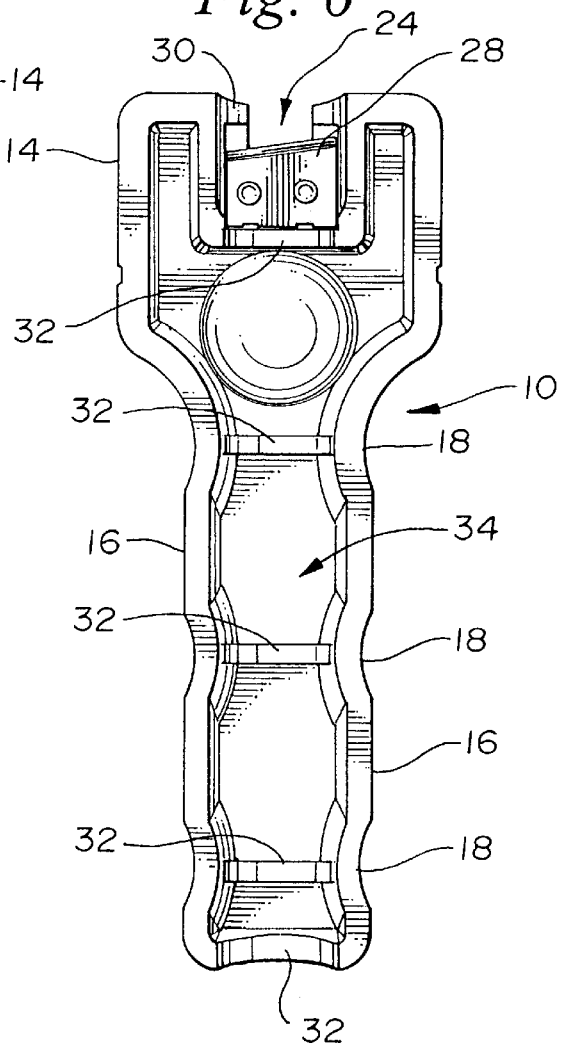
FIG. 6 is a bottom view of the cutting tool, showing the arches of the guide slot and the cutting blade.
Figure 7:
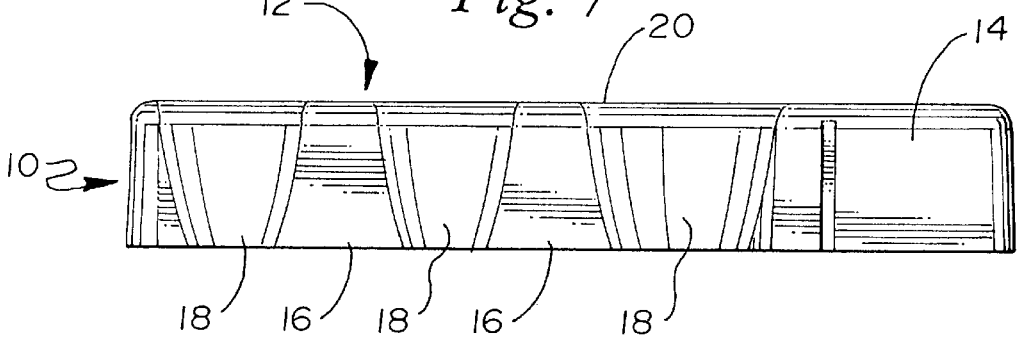
FIG. 7 is side view of the cutting tool, showing finger guides along the handle.

The tool 10 is adapted for being grasped by the fingers of either a left handed or right handed person. The top face 20 of the tool 10 also has a finger hold 22, shaped as a circular depression, as can be seen in FIGS. 1, 5 and 6. The head 14 has a centrally located, distally facing opening 24, with a narrow ramp 26 extending downwardly from the top face 20 of the tool 10 to the exposed edge of the cutting blade 28, which can also be seen in FIGS. 5 and 6. As can be seen with reference to FIG. 3, the base 30 of the opening 24 is semi-circular.

Figure 2:
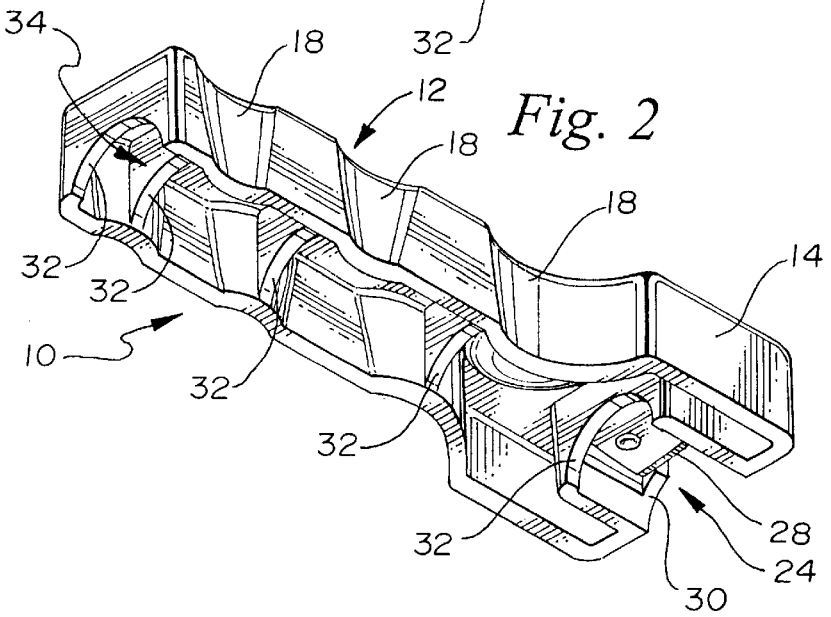
FIG. 2 is a view of the cutting tool with a top surface and one side of the tool removed.

FIG. 2 shows the cutting tool 10 with the top face 20 and one side of the tool 10 removed. A series of same-diameter arches 32 together form a guide 34. The arches 32 are arcs of a circle of a diameter chosen so that the channel-shaped guide 34 will accommodate surgical instruments with handles having a maximum radius segment or region in the arcuate handle cross section from which the bands are to be removed. The exposed edge of the cutting blade 28, as can be seen in FIGS. 2 and 6, is slightly angled or offset relative to the transverse axis of the channel-shaped guide 34 to enhance its slicing or cutting efficacy.

Figure 8:
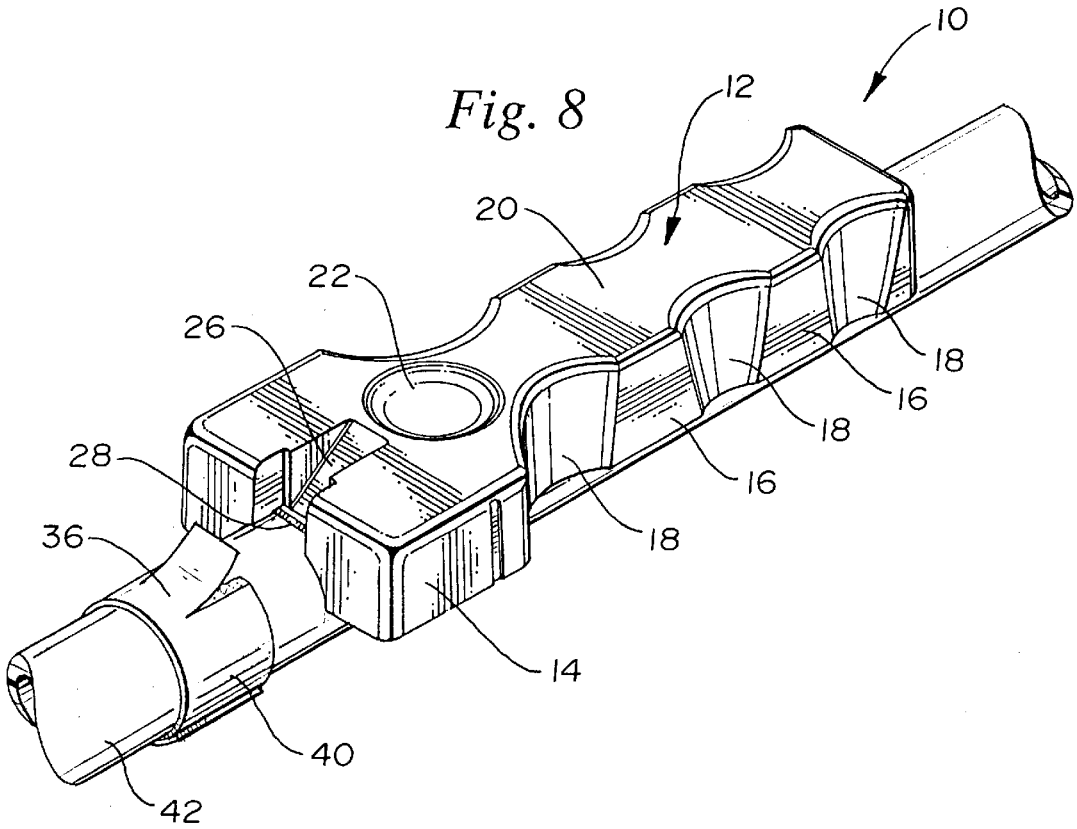
FIG. 8 shows a cutting tool of this invention in position for cutting and removing a full-thickness width of identifying tape from a handle of a surgical instrument.

As can be seen in FIG. 8 and has been discussed above, the cutting tool 10 of this invention is used for slicing the entire width of a band of identification tape 40 from a surgical instrument handle 42, such as the SURG-I-BAND® identifying tape available from the present assignee. The handle 12 of the cutting tool 10 is grasped in one hand with the thumb and fingers positioned in the finger holds 18 on the side walls 16 and (optionally) the forefinger positioned in the finger hold 22 on the top face 20 of the tool 10. The handle 42 of a surgical instrument shown in FIG. 8 is positioned within the elongated guide slot 34 defined by the arches 32, with the band of identification tape 40 located distal of the opening in the head 24 and the distally facing cutting blade 28. The tool can be tilted by angling the distal end slightly upwardly by approximately 15 degrees to increase its cutting efficiency.

By merely sliding the cutting tool 10 along the surgical instrument handle, the cutting blade 28 will engage the band of identification tape 40. As can be seen in FIG. 8, when the cutting blade 28 engages the tape 40, the blade 28 is tangent to the circumference of the surgical instrument handle 42 and defines a chord of the circle of the tape band 40. By continuing to slide the cutting tool 10, the blade 28 will cut and remove a full width of the tape 40 along the path of the blade 28. Once this section of tape 40 has been removed, a fresh edge of tape 40 is exposed. This fresh edge can be easily engaged by a fingernail of the user to allow peeking of the tape from the handle to complete removal of the remainder of the tape band 36.

Preferably, the cutting tool 10 of this invention has an overall length of about 7.6 cm, the handle 12 has an overall width of about 1.6 cm and the head 14 has an overall width of about 2.8 cm. The arches 32 are each arcs of a circle having a diameter of 0.95 cm to accommodate instrument handles housing diameters of 0.95 cm or less. The cutting tool 10 can be constructed of any suitable plastic material, such as acrylic. The cutting tool 10 can be manufactured by any suitable plastic manufacturing process, such as injection molding.

It will be easily understood that, although this tool has been described with regard to the removal of surgical instrument identification tape from a surgical instrument handle, it can be readily used for the removal of other types of tape or similar materials from other cylindrical surfaces of a diameter to be accommodated within the channel-shaped guide 34.

What is claimed is:

1. A cutting tool for removing an encircling band of identification tape from a banded portion of an outer surface of a surgical instrument handle having a cross section with an arcuate portion, the tool comprising;

a housing;

an elongated guide slot opening into one face of the housing, said guide slot forming an instrument handle-engaging surface, said guide slot and said instrument handle-engaging surface having a generally semi-circular cross section, said guide slot having a radius equal to or greater than a maximum radius expected for the arcuate portion of the cross section of handles of surgical instruments with which instruments with which the tool is to be used, said guide slot designed and adapted for receiving a banded portion of a surgical instrument handle in the guide slot as the housing is slid longitudinally along a handle portion; and a tape cutting blade having a cutting edge, the cutting blade mounted within said housing and extending from the semi-circular instrument handle-engaging surface of the guide slot in such a manner that, when viewed along the cross section of the instrument handle-engaging surface, the cutting edge of the tape cutting blade is tangential to the instrument handle-engaging surface for moving tangentially along the outer surface of a surgical instrument handle received in the guide slot without cutting into a surgical instrument handle and for slicing into and through an encircling band of identification tape as the housing is moved longitudinally along a handle of the surgical instrument, the guide slot prohibiting the cutting blade from engaging and cutting through a surgical instrument handle.

2. A cutting tool according to claim 1, wherein the guide slot is defined by a series of arches within the housing.

3. A cutting tool according to claim 1, wherein the tool housing also comprises at least one exterior finger guide for facilitating positioning of the guide slot on the instrument handle and sliding the tool housing along the surgical instrument handle.

4. A cutting tool according to claim 1 wherein the cutting blade is oriented in a plane substantially tangential to the surface of the instrument handle received in the guide slot and the cutting edge of the cutting blade is oriented such that the cutting edge is slightly angled relative to a transverse axis of the guide slot.

5. A cutting tool according to claim 1, constructed of acrylic.

6. A cutting tool for removing an encircling band of identification tape from an outer surface of a surgical instrument handle, the tool comprising:

a surgical instrument-engaging housing having an instrument-engaging surface forming an elongated guide slot that opens into one face of the housing, the instrument-engaging surface having a non-linear cross section and being adapted to receive and engage the outer surface of a surgical instrument handle as the housing is moved longitudinally along a surgical instrument handle; and a tape cutting blade having a cutting edge, the tape cutting blade being mounted to the housing and extending from the instrument engaging surface into the guide slot in such a manner that when viewed along the cross section of the instrument-engaging surface, the cutting edge of the tape cutting blade is tangential to the instrument-engaging surface for tangential engagement of the outer surface of a surgical instrument handle without cutting into the outer surface of a surgical instrument handle and for slicing into and through an encircling band of identification tape as the housing is moved longitudinally along the handle of a surgical instrument, the elongated guide slot acting as a stop member that prohibits the cutting blade from engaging and cutting through a surgical instrument handle.

7. The cutting tool of claim 6, wherein the guide slot has a generally semi-circular cross section, the guide slot having a radius equal to or greater than a maximum radius expected for the surgical instrument handle.

8. The cutting tool of claim 6, wherein the cutting edge of the cutting blade is substantially linear.

9. The cutting tool of claim 6, and further in combination with a surgical instrument having an encircling band of tape on an outer surface of a handle of the surgical instrument, the handle being positioned within the elongated guide slot and in contact with the instrument-engaging surface, the cutting tool engaging and slicing into and through the encircling band of tape as the cutting blade on the handle-engaging surface of the guide slot is moved longitudinally along the surgical instrument handle.

* * * * *

UNITED STATES PATENT AND TRADEMARK OFFICE

CERTIFICATE OF CORRECTION

PATENT NO. : 5,864,953
DATED : February 2, 1999
INVENTOR(S) : Blake

It is certified that error appears in the above-identified patent and that said Letters Patent is hereby corrected as shown below:

In claim 1, at line 13, please delete the phrase "with which instruments".

Signed and Sealed this

Sixth Day of July, 1999

*Attest:*

Q. TODD DICKINSON

*Attesting Officer*

*Acting Commissioner of Patents and Trademarks*